US006176683B1

(12) United States Patent
Yang

(10) Patent No.: US 6,176,683 B1
(45) Date of Patent: Jan. 23, 2001

(54) OUTPUT CONTROL APPARATUS FOR LINEAR COMPRESSOR AND METHOD OF THE SAME

(75) Inventor: Soon-Bae Yang, Seoul (KR)

(73) Assignee: LG Electronics, Inc. (KR)

( * ) Notice: Under 35 U.S.C. 154(b), the term of this patent shall be extended for 0 days.

(21) Appl. No.: 09/301,027

(22) Filed: Apr. 28, 1999

(51) Int. Cl.[7] ..... F04B 49/06

(52) U.S. Cl. ..... 417/44.1; 417/45; 417/53; 73/118.1

(58) Field of Search ..... 417/44.1, 44.11, 417/45, 417, 212, 53; 73/116, 118.1, 168

(56) References Cited

U.S. PATENT DOCUMENTS 4,345,442 * 8/1982 Dorman ..... 62/160
4,613,285 * 9/1986 Sato et al. ..... 417/214
4,831,785 * 5/1989 Sigg ..... 51/165 R
4,842,301 * 6/1989 Feldmaier ..... 208/735
4,879,502 * 11/1989 Endo et al. ..... 318/723
5,083,905 * 1/1992 Mohn ..... 417/415
5,220,259 * 6/1993 Werner et al. ..... 318/432
5,280,222 * 1/1994 Von Der Heide et al. ..... 318/138
5,496,153 * 3/1996 Redlich ..... 417/212

* cited by examiner

*Primary Examiner*—Timothy S. Thorpe
*Assistant Examiner*—Timothy P. Solak
(74) *Attorney, Agent, or Firm*—Ostrolenk, Faber, Gerb & Soffen, LLP

(57) ABSTRACT

An output control apparatus for a linear compressor and a method of the same are disclosed. In the conventional art, when controlling an output of the linear compressor using a stroke, it is possible to implement a constant stroke. However, since the intermediate position of the piston is varied, it is impossible to constantly implement a top dead point. Therefore, an output control of the linear compressor is difficult, and a higher efficiency is not easily implemented. In addition, there is a problem for constantly controlling an output of the linear compressor. Therefore, in the present invention, the timing when the piston and discharge valve collide with each other is determined, and a certain degree of stroke is determined as a control reference stroke based on the thusly determined stroke for thereby controlling the stroke and driving a linear compressor, and then the linear compressor is driven by controlling the stroke, so that it is possible control an output having no deviation in accordance with the system, whereby a higher efficiency operation is implemented irrespective of the size of the load.

3 Claims, 3 Drawing Sheets

OUTPUT CONTROL APPARATUS FOR LINEAR COMPRESSOR AND METHOD OF THE SAME

BACKGROUND OF THE INVENTION

1. Field of the Invention

The present invention relates to an output control apparatus for a linear compressor and a method of the same which make it possible to obtain a better control performance without a deviation in accordance with the type of a system based on the detected magnitude of collision strength for controlling an output of a linear compressor, and in particular to an improved output control apparatus for a linear compressor and a method of the same which are capable of implementing a high efficiency by determining an accurate control target stroke time when a piston and a discharge valve collide with each other in a compressor system and constantly controlling an output of a compressor irrespective of a load applied thereto.

2. Description of the Background Art

As a method for controlling a linear compressor, a sensor less type control method is known. In this type control method, a current and voltage are fed back based on the following Equation 1 for thereby estimating a stroke of a piston, so that the linear compressor is controlled using the thus estimated stroke of the piston.

$$V = \frac{1}{\alpha}\left(V - R \times i - L\frac{di}{dt}\right) \tag{1}$$

where V represents a motor terminal voltage, v represents the speed of a movement unit, R represents a motor resistor, i represents a current, α represents a motor constant, and L represents a motor inductance.

The sensorless control method controls the size of the entire stroke.

The output of the linear compressor is involved in the size of the stroke as well as the position of the top dead point.

Therefore, when the piston arrives at the top dead point, the volume formed by the upper surface of the piston and the inner wall of the cylinder is referred to as a top dead volume. In the same stroke case, if the top dead volume is small, the output is increased, and the efficiency is enhanced.

Here, the position of the piston is computed based on the following Equation (2).

$$x = \int v dt \tag{2}$$

where x represents the motion of the movement unit.

Therefore, the output of the linear compressor is controlled by the size of the stroke and the position of the top dead point of the piston.

In the conventional art, when the output of the linear compressor is controlled using the stroke, the stroke may be constantly controlled. However, in this case, since the intermediate position of the piston is varied based on the load, it is impossible to implement a constant top dead point. Namely, a constant top dead volume is not obtained. Therefore, it is difficult to control the output of the linear compressor and to implement a high efficiency and constant output.

SUMMARY OF THE INVENTION

Accordingly, it is an object of the present invention to provide an output control apparatus for a linear compressor and a method of the same which make it possible to obtain a constant top dead volume irrespective of a load.

It is another object of the present invention to provide an output control apparatus for a linear compressor and a method of the same which make it possible to implement a system operation with a higher efficiency.

In order to achieve the above objects, there is a provided an output control apparatus for a linear compressor which includes a voltage controller for supplying a driving voltage for driving a compressor, a stroke computation unit for receiving a voltage and current detected by a voltage and current sensor when driving the compressor and computing a stroke based on the received voltage and current, a collision detection sensor for detecting a vibration at the time when a piston collides with a discharge valve when driving the compressor, a collision detection unit for detecting whether an abnormal signal is generated due to the vibration detected by the collision detection sensor, a microcomputer for determining a control destination stroke based on a stroke generated from the stroke computation unit, and a driving unit for outputting a voltage driving signal to the voltage controller in accordance with a control destination stroke outputted from the microcomputer.

In order to achieve the above objects, there is provided an output control method for a linear compressor which includes the steps of a first step for storing a stroke inputted, a second step for judging whether a collision occurs between a piston installed in a compressor and a discharge valve, a third step for resetting a control destination stroke based on the stroke stored in the first step when a collision is detected in the second step and controlling to obtain a reset control destination stroke, and a fourth step for obtaining a previously set control destination stroke when a collision is not detected in the second step.

Additional advantages, objects and features of the invention will become more apparent from the description which follows.

BRIEF DESCRIPTION OF THE DRAWINGS

The present invention will become more fully understood from the detailed description given herein below and the accompanying drawings which are given by way of illustration only, and thus are not limitation of the present invention, and wherein.

DETAILED DESCRIPTION OF THE PREFERRED EMBODIMENTS

The embodiments of the present invention will be explained with reference to the accompanying drawings.

Figure 3:
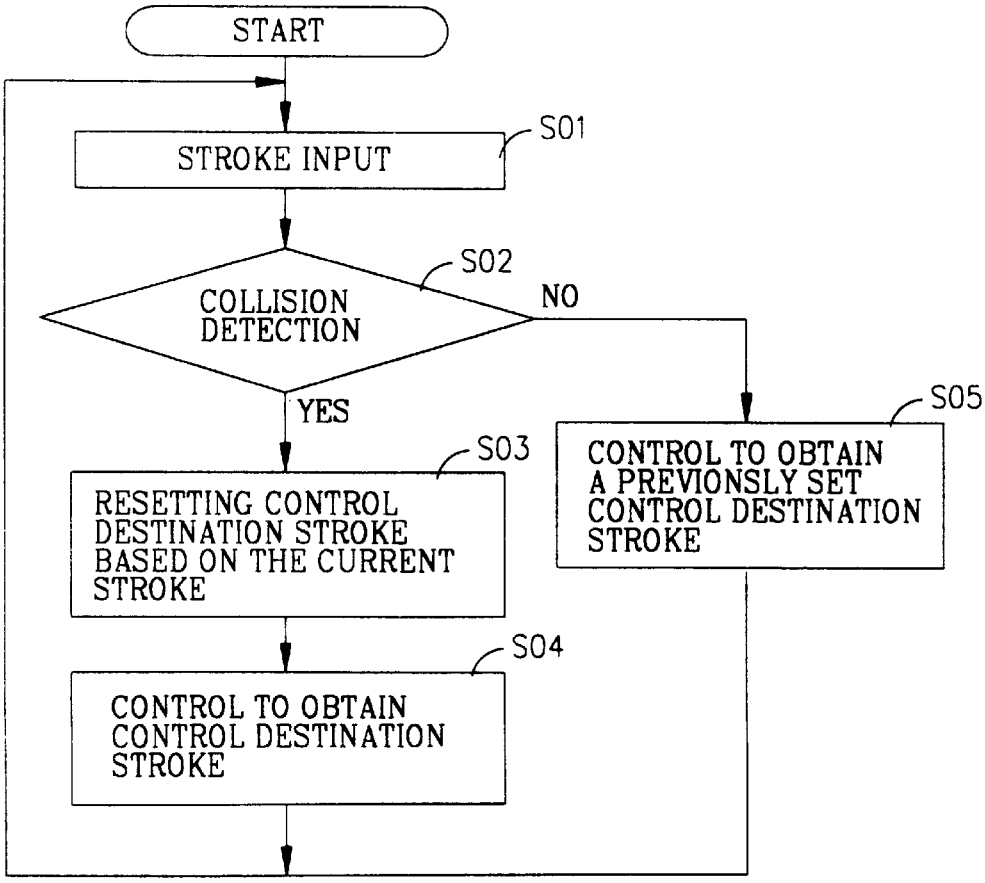
FIG. 3 is a flow chart illustrating a control method of an output control apparatus for a linear compressor of FIG. 1.

FIG. 3 is a flow chart illustrating an output control method for a linear compressor according to the present invention.

As shown therein, the output control method for a linear compressor includes a first step S01 for storing a stroke inputted, a second step S02 for judging whether a collision between a piston installed in a compressor and a discharge valve is detected, a third step S03 for resetting a control destination stroke based on the stroke stored in the first step S01, a fourth step S04 for implementing the set control destination stroke, and a fifth step S05 for controlling so that a previously set stroke becomes the control destination stroke when a collision is not detected in the second step S02.

Figure 1:
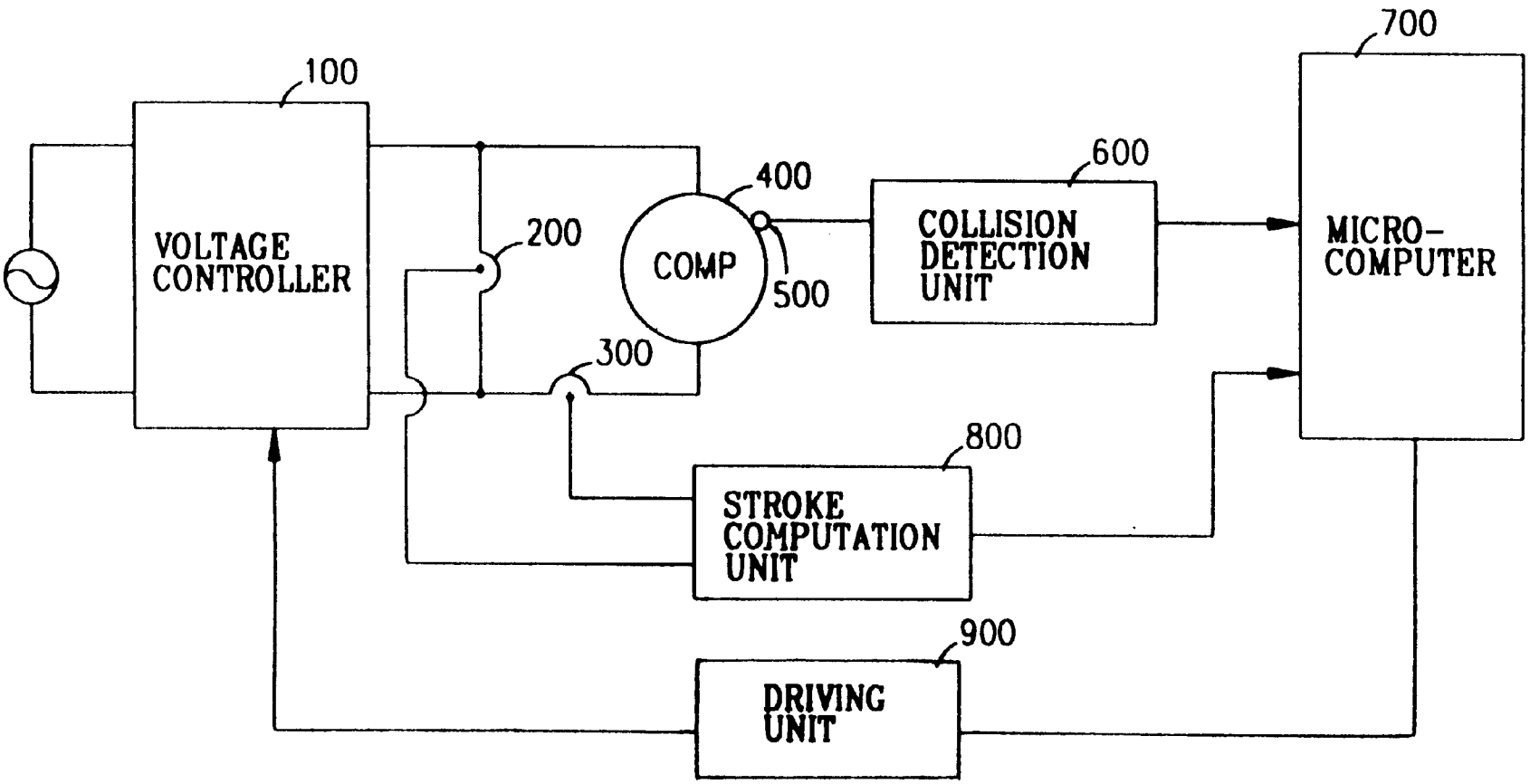
FIG. 1 is a block diagram illustrating an output control apparatus for a linear compressor according to the present invention.

As shown in FIG. 1, the output control apparatus for a linear compressor according to the present invention which is implemented by the above-described steps includes a voltage controller 100 for supplying a driving voltage for driving a compressor 400, a voltage sensor 200 for detecting the voltage which is generated when driving the compressor, a current sensor 300 for detecting a current when driving the compressor, a stroke computation unit 800 for receiving the voltage and current detected by the voltage sensor 200 and the current sensor 300 and computing a stroke based on the received voltage and current, a collision detection sensor 500 for detecting a vibration at the time when the piston collides with the discharge value during an operation of the compressor, a collision detection unit 600 for detecting an abnormal signal due to the vibration detected by the collision detection sensor 500, a microcomputer 700 for determining a control destination stroke based on the stroke generated by the stroke computation unit 800 when an abnormal signal is detected by the collision detection unit 600, and a driving unit 900 for outputting a voltage driving signal to the voltage controller in accordance with a control destination stroke outputted from the microcomputer 700.

Figure 2:
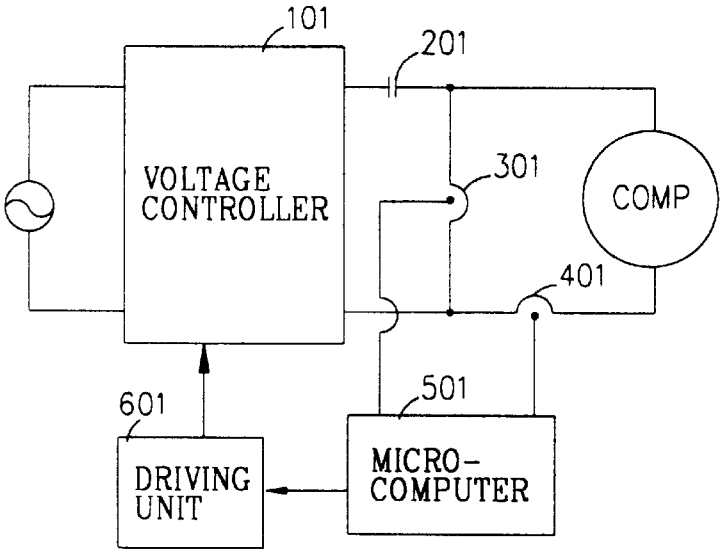
FIG. 2 is a view illustrating another embodiment of an output control method for a linear compressor according to the present invention.
Figure 4:
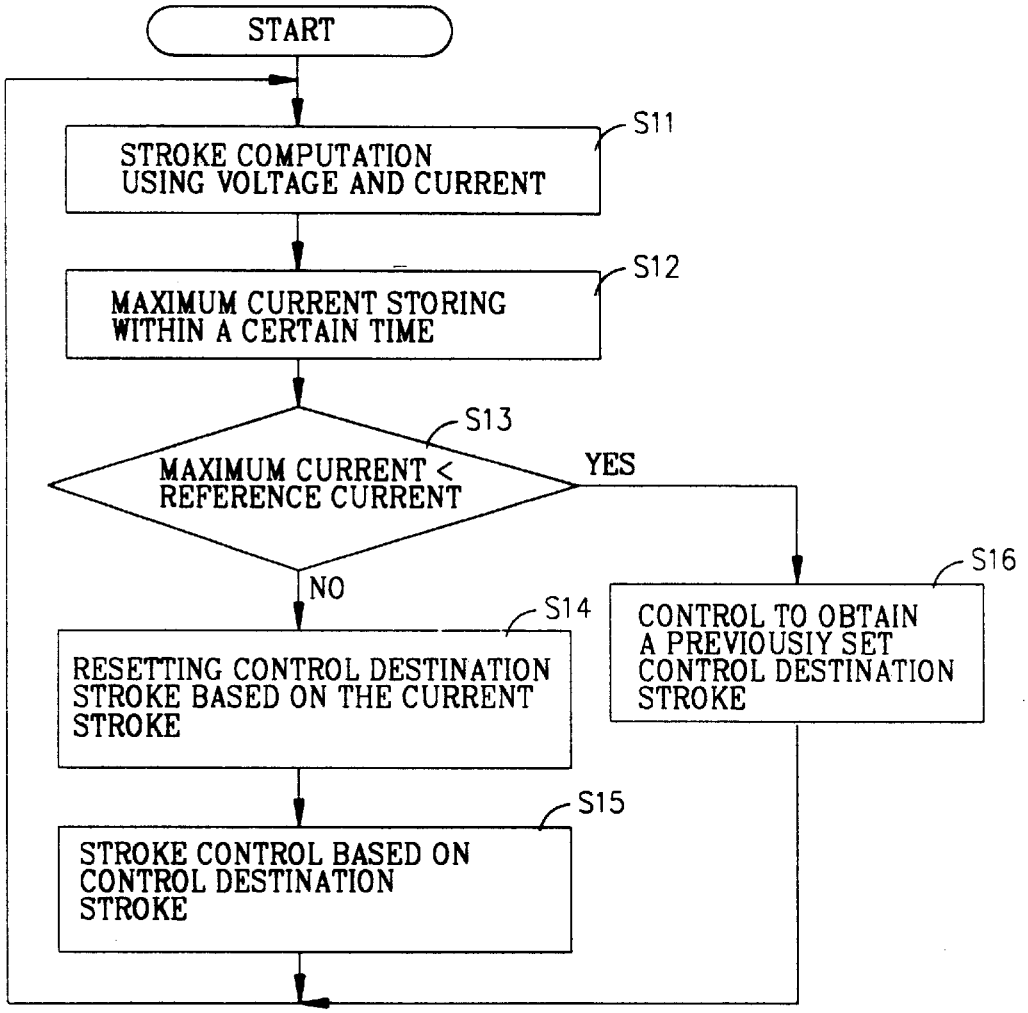
FIG. 4 is a flow chat illustrating an output control apparatus for a linear compressor of FIG. 2.

In another embodiment of the output control apparatus for a linear compressor according to the present invention, as shown in FIGS. 2 and 4, there are provided a voltage controller for supplying a voltage for driving a linear compressor, a condenser connected between the voltage controller and the compressor, a voltage sensor for detecting an input voltage of the linear compressor, a current sensor for detecting a current flowing at the linear compressor, a microcomputer for receiving a voltage from the voltage sensor and a current from the current sensor, computing a stroke, comparing the computed stroke with a control destination stroke, and controlling a stroke, and a driving unit for outputting a driving voltage value to the voltage controller which drives the linear compressor in accordance with the stroke determined by the microcomputer. In addition, the output control method for a linear compressor according to the present invention includes a first step for computing a stroke based on a voltage and current inputted, a second step for storing a maximum current value for a certain time during an operation of the linear compressor, a third step for comparing the stored maximum current value with a reference current value, a fourth step for computing a control destination stroke based on the current stroke if the maximum current value greater than the reference current value and controlling the output of the linear compressor based on the changed control destination stroke, and a fifth step for controlling an output of the linear compressor based on the set control destination stroke if the maximum current value is smaller than the reference current value in the third step.

FIG. 4 is a flow chart illustrating an output control method for a linear compressor according to the present invention which includes a first step S11 for computing a voltage and current inputted, a second step S12 for storing the maximum current value for a certain time when driving the linear compressor among the current values inputted in the first step, a third step S13 for comparing the maximum current value stored in the second step S12 with a reference current value, a fourth step S14 for computing and changing a new control destination stroke based on the current stroke if the maximum current value is greater than the reference current value in the third step S13 and controlling an output of the linear compressor based on the computed and changed control destination stroke, and a fifth step S15 for controlling an output of the linear compressor based on the previously set control destination stroke if the maximum current value is smaller than the reference current value in the third step.

As shown in FIG. 2, the output control apparatus for a linear compressor according to the present invention which implements the above-described steps includes a voltage controller 101 for supplying a voltage for driving a linear compressor COMP, a condenser 201 connected between the voltage controller and the linear compressor COMP, a voltage sensor 301 for detecting a voltage at both ends of the linear compressor, a current sensor 401 for detecting a current flowing at the linear compressor COMP, a microcomputer 501 for receiving a voltage from the voltage sensor 301 and a current from the current sensor 40, computing a stroke, comparing the computed stroke with a control destination stroke, and determining a certain stroke for a control thereof, and a driving unit 601 for outputting a driving voltage value to the voltage controller 101 which drives the linear compressor COMP based on a stroke determined by the microcomputer 501.

The operation of the present invention will be explained with reference to FIGS. 1 and 6.

In the power supply mode, when the voltage controller 100 supplies a driving voltage to the compressor 400, the compressor 400 is driven.

When the compressor 400 is driven, the voltage sensor 200 and the current sensor 300 detect the voltage and current which are generated when the compressor is driven, and the thus detected voltage and current are outputted to the stroke computation unit 800.

At this time, as the piston reciprocates within the interior of the compressor 400, the piston collides with the discharge valve.

The collision detection sensor 500 detects a vibration which occurs at the time when the piston collides with the discharge valve and transmits the detected vibration to the collision detection unit 600.

The collision detection sensor 500 is formed of a piezo sensor or a sensor capable of detecting an acceleration.

The collision detection unit 600 detects an abnormal signal based on the vibration transferred from the collision detection sensor 500. Here, the abnormal signal is referred to as a signal which has a certain level higher than a normal signal level and occurs at the moment when the piston collides with the discharge valve.

When the collision detection unit 600 detects an abnormal signal and outputs the abnormal signal to the microcomputer 700, the microcomputer 700 resets the previously set control destination stroke to the current stroke based on the stroke inputted from the stroke computation unit at the moment when the abnormal signal is detected.

When the thus reset stroke is outputted to the driving unit 900, the driving unit 900 outputs a driving voltage signal to the voltage controller 100 to implement a certain stroke and controls the driving voltage for driving the compressor 400.

The above-described resetting operation will be explained with reference to FIG. 3. The microcomputer 700 receives a stroke from the stroke computation unit 800 in Step S01 and detects a signal from the collision detection unit 600 in Step S02.

When an abnormal signal is outputted from the collision detection unit 600, the microcomputer 700 recognizes a time when the abnormal signal is inputted at a time at which the piston of the compressor 400 collides with the discharge valve. At this time, the control destination stroke which is previously set based on the stroke inputted from the stroke computation unit 800 is changed by a certain degree for thereby resetting the currently inputted stroke as a control destination stroke in Step S03. When the thus reset control destination stroke is outputted, the compressor 400 operates to obtain a control destination stroke.

Another embodiment of the output control apparatus for a linear compressor according to the present invention will be explained with reference to FIGS. 2 and 4.

When a driving voltage is supplied from the voltage controller 101 to the linear compressor COMP, the linear compressor COMP is driven.

When the linear compressor COMP is driven, the piston reciprocates and collides with the discharge valve.

At the time when the piston collides with the discharge valve, the current is largely changed. The current sensor 401 detects the size of the thus changed current size.

Figure 5:
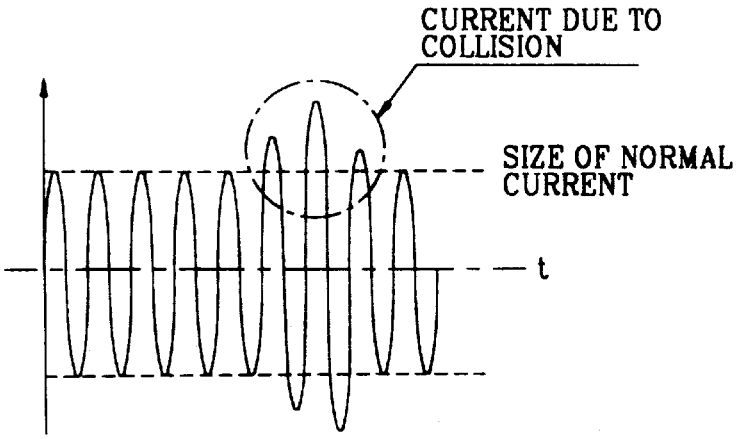
FIG. 5 is a view illustrating an embodiment of a current wave form of a signal from an output control apparatus for a linear compressor of FIG. 2.

FIG. 5 illustrates a current wave form when the piston collides with the discharge valve.

The voltage sensor 301 receives a certain size of the current detected by the current sensor 401 and changes the thus received current to a voltage which is proportional to the level of the current and outputs to the microcomputer 501.

When the microcomputer 501 obtains a control destination stroke through the process as shown in FIG. 2 and outputs the thus obtained stroke to the driving unit 601, the driving unit 601 outputs the driving voltage signal to the voltage controller 101 based on the control destination stroke from the microcomputer 501.

The voltage controller 101 outputs a driving voltage to the linear compressor COMP based on the driving voltage signal from the driving unit 601 for thereby driving the linear compressor.

The operation of the microcomputer 501 will be explained with reference to FIG. 4. First, the microcomputer 501 receives a voltage from the voltage sensor 301 and a current from the current sensor 401 and computes a stroke in Step S11.

In addition, the maximum current value among the current values detected by the current sensor 401 while the linear compressor COMP is being driven is stored in Step S12.

Thereafter, the maximum current value stored for a certain time and the reference current value are compared in Step S13.

As a result of the comparison, if the maximum current value is greater than the reference current value, the control destination stroke is reset based on the current stroke computed in Step S11 in Step S14, and the linear compressor COMP is controlled based on the thus reset control destination stroke.

In addition, if the maximum current value is smaller than the reference current value, the linear compressor COMP is controlled in accordance with the previously set control destination stroke in Step S16.

The above-described operation is repeatedly performed, and the control destination stroke is set to a maximum value at a certain time interval, so that the output of the linear compressor is controlled based on the thus set maximum value.

Therefore, in the present invention, it is possible to obtain a constant top dead volume irrespective of the load by controlling the stroke based on the moment when the piston of the linear compressor collides with the discharge valve. In addition, it is possible to implement an operation at an accurate dead point for thereby obtaining a higher efficiency. In the present invention, the problem that when a greater load is applied to the compressor the output is decreased to prevent the collision and to increase the efficiency, Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. An output control apparatus for a linear compressor, comprising:

a voltage controller for supplying a driving voltage for driving a compressor;

a stroke computation unit for receiving a voltage and current detected by a voltage and current sensor when driving the compressor and computing a stroke based on the received voltage and current;

a collision detection sensor for detecting a vibration at the time when a piston collides with a discharge valve when driving the compressor;

a collision detection unit for detecting whether a collision detection signal is generated due to the vibration detected by the collision detection sensor;

a microcomputer for determining a control destination stroke based on a stroke generated from the stroke computation unit; and a driving unit for outputting a voltage driving signal to the voltage controller in accordance with a control destination stroke outputted from the microcomputer.

2. An output control method for a linear compressor, comprising:

a first step for storing a stroke outputted from a stroke computation unit;

a second step for judging whether a collision has occurred between a piston installed in a compressor and a discharge valve;

a third step for resetting a control destination stroke based on the stroke stored in the first step when a collision is detected in the second step and controlling an output of the linear compressor based on the newly set control destination stroke; and a fourth step for obtaining the control setting stroke stored in the first step when a collision is not detected in the second step.

3. An output control method for a linear compressor, comprising:

a first step for computing an operating stroke based on a voltage and current inputted;

a second step for storing a maximum current value for a predetermined time set by a user when driving the linear compressor;

a third step for comparing the stored maximum current value with a reference current value corresponding to a collision;

a fourth step for calculating a new control destination stroke based on the current stroke when the maximum current value is greater than the reference current value in the third step and controlling an output of the linear compressor based on the set control destination stroke; and a fifth step for controlling an output of the linear compressor based on the previously set control destination stroke when the maximum current value is smaller than the reference current value in the third step.

* * * * *